United States Patent [19]

Baumann

[11] 4,350,493

[45] Sep. 21, 1982

[54] CARRIER COMPOSITION FOR DISPERSE DYES

[75] Inventor: Hans-Peter Baumann, Ettingen, Switzerland

[73] Assignee: Sandoz Ltd., Basel, Switzerland

[21] Appl. No.: 248,625

[22] Filed: Mar. 27, 1981

[30] Foreign Application Priority Data

Mar. 27, 1980 [CH] Switzerland ..... 2422/80

[51] Int. Cl.[3] ..... C09B 67/00

[52] U.S. Cl. ..... 8/617; 8/907; 252/8.9

[58] Field of Search ..... 8/907, 617; 252/8.9

[56] References Cited

U.S. PATENT DOCUMENTS 3,097,047 7/1963 Weinstein et al. ..... 8/617
3,706,530 12/1972 Baumann et al. ..... 8/617

FOREIGN PATENT DOCUMENTS 828150 8/1975 Belgium .
1288828 3/1962 France .
40-24953 10/1965 Japan .

*Primary Examiner*—A. Lionel Clingman
*Attorney, Agent, or Firm*—Gerald D. Sharkin; Richard E. Vila; Thomas C. Doyle

[57] ABSTRACT

The present invention provides a composition for dyeing or printing with disperse dyestuffs comprising (a) 70–87.5% by weight of an aromatic hydrocarbon mixture containing more than 30% by weight of a mixture of alkylbenzenes having two or more methyl groups or at least one ethyl, propyl or butyl group on the benzene nucleus, which aromatic hydrocarbon mixture has a boiling point range of from 160° to 280° C.;
(b) 10 to 20% by weight of the condensation product of castor oil with 30 to 50 mols ethylene oxide;
(c) 0.5 to 5% by weight of the condensation product of a fatty acid wih 5 to 8 mols ethylene oxide and
(d) 2 to 5% by weight paraffin oil and the preparation is free from any anionic dispersing agent.

19 Claims, No Drawings

CARRIER COMPOSITION FOR DISPERSE DYES

The present invention relates to a carrier preparation and a process for dyeing or printing employing the same.

More particularly, the present invention provides a composition suitable for use as a carrier preparation for dyeing or printing with disperse dyestuffs comprising (a) 70–87.5% by weight of an aromatic hydrocarbon mixture containing more than 30% by weight of a mixture of alkylbenzenes having two or more methyl groups or at least one ethyl, propyl or butyl group on the benzene nucleus, which aromatic hydrocarbon mixture has a boiling point range of from 160° to 280° C.;

(b) 10 to 20% by weight of the condensation product of castor oil with 30 to 50 mols ethylene oxide;

(c) 0.5 to 5% by weight of the condensation product of a fatty acid with 5 to 8 mols ethylene oxide and (d) 2 to 5% by weight paraffin oil and the preparation is free from any anionic dispersing agent.

The aromatic hydrocarbons (a) are for example those distillation residues from industrial production of ortho-, meta- or paraxylenes or other alkylbenzenes, from industrial cracking and hydrogenation processes and the like. The mixture (a) preferably contains more than 50%, more preferably at least 70% by weight of alkylbenzenes. In addition the alkylbenzene mixture may contain distillation residues such as diphenyl, naphthalene, anthracene, phenanthrene, fluorene, and derivatives thereof. When the mixture (a) is essentially free from the above-mentioned higher molecular weight compounds the boiling point range of the mixture is between 180° and 215° C.

Other representative mixtures (a) are those which contain 80% by weight diethylbenzenes and approximately 20% by weight butyl, triethyl and tetraethylbenzenes and boil in the range of from 160°–180° C. and those which contain 90% by weight isomeric mixture of trimethylbenzenes and up to 10% by weight of higher alkyl benzenes and boil in the range of from 170° to 215° C.

The carrier preparation of the invention preferably contains from 78 to 84% by weight of component (a).

Component (b) preferably contains from 30 to 35 ethylene oxide units. Preferably component (b) is present in amounts of from 10 to 15% by weight.

The fatty acids in component (c) suitably contain from 14 to 24 carbon atoms, with oleic acid being most preferred. Component (c) is preferably present in amounts of from 1 to 5% by weight, more preferably up to 2% by weight.

Preferably 4 to 5% of paraffin oil (d) is present in the carrier preparation.

The carrier preparations according to the invention have anti-foaming properties. In addition to good carrier activity which is especially notable with strong coloured dyestuffs, the preparations possess levelling activity. Further the preparations promote migration which is advantageous with stripey substrates, especially with differentially stretched polyester textiles. The preparations are especially effective at temperatures above 100° C. e.g. up to 130° C. Additionally, the dispersion stability of the disperse dyestuffs is not negatively influenced (especially with polyester rapid dyeing processes).

The present invention further provides a process for dyeing or printing synthetic or semi-synthetic hydrophobic, high-molecular weight organic textile substrates comprising employing a carrier preparation as defined above. Suitable textile substrates include cellulose triacetate and especially linear, aromatic polyesters. Dyeing and printing is effected in accordance with known methods. The carrier preparation is employed in amounts of from 2 to 35% by weight based on the substrate.

The following Examples further serve to illustrate the invention. In the Examples all parts are by weight and all temperatures in degrees Centigrade.

EXAMPLE 1

100 Parts polyester fabric are added at 40° to a bath containing 4000 parts water, 2 g/l ammonium sulphate (anhydrous), 0.6 parts of disperse dyestuff preparation of C.I. Disperse Blue 87 (containing 30% by weight dyestuff) and 6 parts of carrier consisting of:

80 parts mixture of
- 5% 1,2,3-trimethylbenzene,
- 10% mixture of 1,3,5-trimethylbenzene and tert.-butylbenzene,
- 16% mixture of 1,2,4-trimethylbenzene and sec.-butylbenzene,
- 27% o,m,p-ethyltoluene, 8% propylbenzene,
- 3% isopropylbenzene, 5% butylbenzene,
- 20% diphenyl, 1% naphthalene, 5% anthracene, phenanthrene, fluorene (boiling point range 160°–280°)

13 parts condensate of castor oil with 32 mols ethyleneoxide 2 parts condensate of oleic acid with 6 mols ethyleneoxide 5 parts paraffin oil.

The bath is adjusted to pH 5 with formic acid and is heated to 97° over 30 minutes. Dyeing is effected for 1 hour at this temperature. After washing and rinsing, an even blue dyeing with good properties is obtained.

EXAMPLE 2

Polyester fabric is printed with a paste containing:

30 parts dyestuff preparation of C.I. Disperse yellow 64 (containing 30% dyestuff)

500 parts 10% thickener based on locust bean gum 70 parts carrier consisting of
- 82 parts mixture of 0.5% ethylbenzene, 1% p-xylene, 2% m-xylene, 3% o-xylene, 1% isopropylbenzene, 20% mixture of m-ethyltoluene and p-ethyltoluene, 7% 1,3,5-trimethylbenzene, 6.5% mixture of o-ethyltoluene and isobutylbenzene, 30% 1,2,4-trimethylbenzene, 4.5% n-propylbenzene, 0.5% sec-butylbenzene, 1,5% 1,3-diethylbenzene, 8.5% mixture of 1,4-diethylbenzene, n-butylbenzene and 1,2,3-trimethylbenzene, 1% 4-tert.-butylbenzene, 2% 1,2-diethylbenzene, 2% indole, 9% higher mol-wt. aromatics (boiling point range 160°–240°)
- 12 parts condensate of castor oil with 32 mols ethylene oxide
- 2 parts condensate of oleic acid with 5 mols ethylene oxide and
- 4 parts paraffin oil 400 parts water.

After printing, drying is effected at 60° to 100° and the fabric is steamed for 20 minutes. After rinsing and drying a yellow print with good properties is obtained.

EXAMPLE 3

A polyester ribbon (diolene-satin ribbon) consisting of less stretched (1:3,2) and normal stretched (1:3,66) yarn is dyed at a liquor to goods ratio of 40:1 in a bath containing:

8 g/l dyestuff preparation of C.I. Disperse Blue 87 (containing 30% dyestuff)
2 g/l ammonium sulphate,
4 g/l citric acid and
2 g/l carrier of Example 1.

Dyeing is commenced at 60°, the bath is heated to 130° over a period of 45 minutes and dyeing is effected at this temperature for 1 hour. After rinsing a stripe-free dyed ribbon is obtained.

EXAMPLE 4

Polyester (Dacron) Wool gaberdine (55/45) is dyed with a liquor to goods ratio of 1:20 in a bath containing:

0.365 g/l dyestuff preparation of Forosyn Yellow PW*
0.115 g/l dyestuff preparation of Forosyn Red PW*
0.22 g/l dyestuff preparation of Forosyn Black PW*
*commercial mixture of disperse and anionic dyestuffs
2.00 g/l carrier of Example 1.

The pH value of the bath is adjusted to 5 to 6 with acetic acid. The fabric is put in the bath at 60°, the bath is raised to 106° in 45 minutes and dyeing is effected at this temperature for 1 hour. After rinsing an evenly dyed fabric is obtained.

EXAMPLE 5

In accordance with the procedure of Example 3, but employing 8%, based on the weight of the substrate, of the following carrier:

80 parts aromatic mixture the majority of which is an alkylbenzene ($C_{10}$) mixture, and which is a waste product from oil distillation and has the following characteristics density
($d_4^{20}$) 0.840–0.893
($n_D^{20}$) 1.511–1.515
distillation range 180°–210°
3.6 parts paraffin oil
0.3 parts solid paraffin
1.1 part oleic acid condensed with 6 mols ethylene oxide
15.0 parts castor oil condensed with 32 mols ethylene oxide an even, stripe-free dyed fabric is obtained.

EXAMPLE 6

In accordance with the procedure of Example 3 polyester is dyed employing the same carrier but with the exception that the 80 parts of aromatic hydrocarbons were replaced with 80 parts of the following mixture:

| | |
|---|---|
| saturated hydrocarbon | 0.1 wt. % |
| ethylbenzene | 0.3 |
| para-xylene | 0.4 |
| meta-xylene | 1.1 |
| isopropylbenzene | 0.4 |

-continued

| | |
|---|---|
| ortho-xylene | 1.8 |
| n-propylbenzene | 3.0 |
| 1-methyl-3-ethylbenzene | 5.8 |
| 1-methyl-4-ethylbenzene | 15.3 |
| 1,3,5-trimethylbenzene | 7.3 |
| sec-butylbenzene | 0.4 |
| 1-methyl-2-ethylbenzene | 7.1 |
| 1-methyl-3-isopropylbenzene<br>1-methyl-4-isopropylbenzene | 0.9 |
| 1,2,4-trimethylbenzene | 33.4 |
| 1-methyl-3-n-propylbenzene<br>1-methyl-4-n-propylbenzene | 5.0 |
| n-butylbenzene | 0.4 |
| 1,4-diethylbenzene | 0.5 |
| 1,4-dimethyl-5-ethylbenzene | 2.7 |
| 1,2,3-trimethylbenzene | 9.0 |
| 1,4-dimethyl-2-ethylbenzene | 1.0 |
| 1,3-dimethyl-4-ethylbenzene | 0.7 |
| indane | 1.4 |
| $C_{11}$-aromatics | 0.1 |
| dimethylethylbenzene | 1.3 |
| 1,2-dimethyl-3-ethylbenzene | 0.1 |
| 1,2,4,5-tetramethylbenzene | 0.2 |
| 1,2,3,5,-tetramethylbenzene | 0.2 |
| 1,2,3,4,-tetramethylbenzene | 0.1 |
| | 100.0 |

EXAMPLE 7

Equally good results are obtained by replacing the 80 parts hydrocarbons of Example 6 with 80 parts of the following mixture:

1.4% ethylbenzene
4.7% sec.-butylbenzene
84.7% diethylbenzene (b. pt. 182°–185°)
4,8% 1,3,5-triethylbenzene
4.2% 1,2,4-triethylbenzene
0.2% tetraethylbenzene

EXAMPLE 8

Replacing the carrier based in Example 3 with same amount of following carrier 5 parts paraffin oil
5 parts oleic acid condensed with 6 mols ethyleneoxide
20 parts castor oil condensed with 50 mols ethylene oxide and
70 parts aromatic consisting of 99% isomeric mixture of trimethylbenzenes, 1% nonsulphonatable hydrocarbon
Distillation analysis as follows:
boiling begins at 164°
5% by vol. distilled by 168°
95% by vol. distilled by 191°
98% by vol. distilled by 220°
especially good results are obtained.

EXAMPLE 9

Replacing the hydrocarbon mixture used in Example 3 with 80 parts of the following mixture

| | |
|---|---|
| meta- and para-xylene | 0.10 wt. % |
| ortho-xylene | 0.12 |
| n-propylbenzene | 0.09 |
| 1-ethyl-2-methylbenzene | 0.81 |
| 1-ethyl-3-methylbenzene | 0.48 |
| 1-ethyl-4-methylbenzene | 0.29 |
| 1,2,3-trimethylbenzene | 6.01 |

-continued

| | |
|---|---|
| 1,2,4-trimethylbenzene | 9.06 |
| 1,3,5-trimethylbenzene | 0.77 |
| indane | 1.9 |
| n-butylbenzene | 1.72 |
| isobutylbenzene | 0.34 |
| sec.-butylbenzene | 0.37 |
| 1-methyl-2-n-propylbenzene | 2.42 |
| 1-methyl-3-n-propylbenzene | 5.09 |
| 1-methyl-4-n-propylbenzene | 2.78 |
| 1-methyl-2-isopropylbenzene | 0.10 |
| 1-methyl-3-isopropylbenzene | 0.91 |
| 1-methyl-4-isopropylbenzene | 0.35 |
| 1,2-diethylbenzene | 0.52 |
| 1,3-diethylbenzene | 1.44 |
| 1,4-diethylbenzene | 1.84 |
| 1-ethyl-2,3-dimethylbenzene | 1.74 |
| 1-ethyl-2,4-dimethylbenzene | 5.08 |
| 1-ethyl-3,4-dimethylbenzene | 7.84 |
| 1-ethyl-3,5-dimethylbenzene | 5.23 |
| 2-ethyl-1,3-dimethylbenzene | 0.72 |
| 2-ethyl-1,4-dimethylbenzene | 4.76 |
| 1,2,3,4-tetramethylbenzene | 3.26 |
| 1,2,3,5-tetramethylbenzene | 8.78 |
| 1,2,4,5-tetramethylbenzene | 5.97 |
| 1-methylindane | 0.65 |
| 2-methylindane | 0.42 |
| 4-methylindane | 3.00 |
| 5-methylindane | 0.88 |
| naphthalene | 5.37 |
| $C_{11}$-monoaromatics | 8.38 |
| $C_{11}$-diaromatics | 0.98 |
| saturated hydrocarbons | 0.24 |
| non identified | 0.09 |
| equally good results are obtained. | |

What is claimed is:

1. A composition comprising (a) 70–87.5% by weight of an aromatic hydrocarbon mixture containing more than 30% by weight of a mixture of alkylbenzenes having two or more methyl groups or at least one ethyl, propyl or butyl group on the benzene nucleus, which aromatic hydrocarbon mixture has a boiling point range of from 160° to 280° C.;

(b) 10 to 20% by weight of the condensation product of castor oil with 30 to 50 mols ethylene oxide;

(c) 0.5 to 5% by weight of the condensation product of a fatty acid with 5 to 8 mols ethylene oxide and (d) 2 to 5% by weight paraffin oil, said composition being free from any anionic dispersing agent.

2. A composition according to claim 1, in which the mixture of aromatic hydrocarbons (a) has a boiling point range of from 170° to 215° C.

3. A composition according to claim 1 or claim 2, in which the hydrocarbon mixture (a) contains more than 50% by weight alkylbenzenes.

4. A composition according to claim 3, in which the mixture (a) contains at least 70% by weight alkylbenzenes.

5. A composition according to claim 1, in which component (b) contains from 30 to 35 ethylene oxide units.

6. A composition according to claim 1, in which the fatty acid of component (c) contains 12 to 24 carbon atoms.

7. A composition according to claim 6, in which the fatty acid is oleic acid.

8. A composition according to claim 1 which contains 78 to 84% by weight component (a), 10 to 15% by weight component (b), 1 to 5% by weight component (c) and 4 to 5% by weight component (d).

9. A process for dyeing or printing hydrophobic, high-molecular weight organic textile substrates with a disperse dyestuff, comprising employing a carrier composition as defined in claim 1.

10. A process according to claim 9, in which the substrate is a linear, aromatic polyester.

11. A composition according to claim 1 wherein component (a) contains 80% by weight diethylbenzenes and approximately 20% by weight butyl, triethyl and tetraethylbenzenes and boils in the range 160°–180° C.

12. A composition according to claim 2 wherein component (a) contains 90% by weight of an isomeric mixture of trimethylbenzenes and up to 10% by weight of higher alkyl benzenes.

13. A composition according to claim 1 wherein component (a) contains more than 50% by weight of alkylbenzenes, component (b) contains 30 to 35 ethylene oxide units and component (c) is a condensation product of a fatty acid of 12 to 24 carbon atoms.

14. A composition according to claim 13 wherein component (a) contains more than 70% by weight of alkylbenzenes and component (c) is a condensation product of oleic acid.

15. A composition according to claim 13 or 14 which contains 78 to 84% by weight component (a), 10 to 15% by weight component (b), 1 to 5% by weight component (c) and 4 to 5% by weight component (d).

16. A process for dyeing or printing hydrophobic, high molecular weight organic textile substrates with a disperse dyestuff which comprises employing as carrier for the disperse dyestuff a composition according to claim 13 or 14.

17. A process according to claim 9 wherein the dyeing or printing is effected in the presence of the carrier composition at a temperature between 100° and 130° C.

18. A process according to claim 10 wherein the dyeing or printing is effected in the presence of the carrier composition at a temperature between 100° and 130° C.

19. A process according to claim 16 wherein the dyeing or printing is effected in the presence of the carrier composition at a temperature between 100° and 130° C.

* * * * *